United States Patent [19]

Fujino et al.

[11] Patent Number: 4,779,667

[45] Date of Patent: Oct. 25, 1988

[54] DEGASSING APPARATUS FOR A METAL MOLD

[75] Inventors: Kiyoshi Fujino; Kenji Ishimoto; Minoru Kuriyama; Kousei Murakami, all of Ube, Japan

[73] Assignee: Ube Industries, Ltd., Yamaguchi, Japan

[21] Appl. No.: 166,294

[22] Filed: Mar. 8, 1988

[30] Foreign Application Priority Data

Mar. 13, 1987 [JP] Japan ..... 62-56798
Nov. 11, 1987 [JP] Japan ..... 62-283123

[51] Int. Cl.[4] ..... B22D 17/14

[52] U.S. Cl. ..... 164/305; 164/410; 425/420; 425/812

[58] Field of Search ..... 164/305, 410; 425/420, 425/812

[56] References Cited

U.S. PATENT DOCUMENTS 4,431,047 2/1984 Takeshima et al. ..... 164/253
4,691,755 9/1987 Kuriyama et al. ..... 164/305

*Primary Examiner*—Kuang Y. Lin
*Attorney, Agent, or Firm*—Townsend & Townsend

[57] ABSTRACT

A degassing apparatus for a metal mold comprises a valve body and a bypass. The valve body is slidably provided between an end of a vent groove communicating with a metal mold cavity and a valve opening/closing portion before an exhaust hole. When a molten metal flowing from the cavity acts on a surface of the valve body, the valve body moves toward the exhaust hole and blocks a path toward the exhaust hole. The bypass bypasses a valve head of the valve body from the vent groove and guides gas to the exhaust hole. The valve head of the valve body has a substantially head-cutting conical outer shape projecting in the direction of the vent groove. The vent groove has a gas vent path extending from a top portion to the vicinity of the base of the valve head along an outer surface of the valve head. An end portion of the gas vent path corresponding to the base of the valve head communicates with a start portion of the bypass which bypasses the valve head.

20 Claims, 6 Drawing Sheets

DEGASSING APPARATUS FOR A METAL MOLD

BACKGROUND OF THE INVENTION

The present invention relates to a degassing apparatus for a metal mold which degasses a cavity of the metal mold during injection molding by an injection molding apparatus, a die-cast machine or the like.

In a conventional injection molding apparatus, for example, a die-cast machine, when a molten metal is charged in the mold cavity at high speed and high pressure, gas in the mold cavity often cannot be sufficiently removed and may become mixed with the molten metal used to form a product, thus forming a void in the molded product.

U.S. Pat. No. 4,431,047 ('047 patent) describes a degassing apparatus for a metal mold which can remove a large volume of gas within a short period of time. The degassing apparatus comprises a vent groove formed on the dividing or mating surfaces of the metal mold. The vent groove communicates with the mold cavity.

The apparatus described in the '047 patent also includes a valve having a reciprocatively movable valve body, and a bypass conduit which provides an exhaust path from the mold cavity. The bypass conduit joins the vent groove midway along its length and connects with the valve. The valve body may be moved between an open and closed position. In the open position, the valve body allows gas from the bypass conduit to pass freely through the valve. In the closed position, the valve body blocks the bypass conduit and the vent groove so that no molten metal may pass into the valve. The valve body is positioned in line with the vent groove at an end of the groove that is distal from the mold cavity.

The degassing apparatus of the '047 patent allows gas in the mold cavity to escape during injection molding through the bypass conduit and the valve. When molten metal is charged in the cavity and reaches the end of the vent groove, the molten metal has sufficient mass to push the valve body from the open position to the closed position, whereupon the bypass conduit and vent groove are closed so that no molten metal can escape.

Although the degassing apparatus described in the '047 patent works satisfactorily in many applications, it has a number of inherent drawbacks.

More specifically, in the conventional degassing apparatus for a metal mold described above, when the flow speed of the molten metal into the vent groove is low or the flow amount is small, thus providing a small inertia force, the valve is not often completely closed. In addition, since a vacuum suction device is used, part of the molten metal undesirably often flows to the vent path before the molten metal sufficiently acts on the valve body. In this case, the molten metal forms splashes or droplets and attaches to and is solidified on the tapered portion on the outer surfaces of the upper portion of the valve head or the valve seat. Then, the valve cannot be fully opened, the molten metal flows into the valve chamber and damages it, or the molten metal flows out from the valve chamber.

SUMMARY OF THE INVENTION

It is, therefore, a principal object of the present invention to provide a degassing apparatus for a metal mold wherein the valve of the conventional type can be reliably closed.

It is another object of the present invention to provide a degassing apparatus for a metal mold wherein a molten metal is prevented from flowing into a valve chamber or blowing out from the apparatus.

It is still another object of the present invention to provide a degassing apparatus for a metal mold wherein a valve is reliably closed even when an inertia force of a molten metal acting on a valve body is small.

It is still another object of the present invention to provide an improved degassing apparatus for a metal mold wherein a gas is reliably exhausted.

In order to achieve these objects, according to the present invention, the valve body of the valve has a substantially conical shape projecting toward the vent groove. The end portion of the vent groove is a groove-like path extending near the base of the outer surface of the valve body along the surface of the valve body. A start portion of a bypass exhaust path communicates with the end portion of the groove-like path.

With this arrangement, when molten metal is charged into the cavity, the gas in the cavity is exhausted outside the die-cast machine through the vent groove and vent path. On the other hand, the molten metal flows in the groove-like path extending from the vent groove along the conical surface of the valve body. The total weight of the molten metal acts on the valve body before the molten metal flows into the bypass exhaust path to fully open the valve.

Therefore, according to an aspect of the present invention, there is provided a degassing apparatus for a metal mold, comprising valve means, slidably provided between an end of a degassing channel communicating with a metal mold cavity and a valve opening/closing portion before an exhaust port and having a surface on which a molten metal flowing from the cavity acts, for moving toward the exhaust port and for blocking a path toward the exhaust port and a bypass for bypassing a valve head of the valve means from the degassing channel and guiding gas to the exhaust port, wherein the valve means has the valve head having a substantially head-cutting conical outer shape projecting in the direction of the degassing channel, the degassing channel has a gas vent path extending from a top portion to the vicinity of the base of the valve head along an outer surface of the valve head, and an end portion of the gas vent path corresponding to the base of the valve head communicates with a start portion of the bypass which bypasses the valve head.

BRIEF DESCRIPTION OF THE DRAWINGS

FIGS. 1 and 2 show arrangements of degassing apparatuses for a metal mold, in which FIG. 1 is a partially sectional front view of a vent valve with its periphery seen from the split or mating surfaces of the metal mold according to an embodiment of the present invention, and FIG. 2 is a partially sectional front view of a vent valve with its periphery according to another embodiment of the present invention and corresponding to FIG. 1;

FIGS. 3 to 6 show arrangements of degassing apparatuses for a metal mold, in which FIG. 3 is a partially sectional view of a vent valve with its periphery seen from the split surface of the metal mold according to still another embodiment of the present invention, FIGS. 4 and 5 are partially sectional front views of vent valves with their peripheries according to still other embodiments of the present invention, respectively, and corresponding to FIG. 3, and FIG. 6 is a longitudinal sectional view of a molten metal path with its periphery according to still other embodiment of the present invention.

DETAILED DESCRIPTION OF THE PREFERRED EMBODIMENTS

Figure 1:
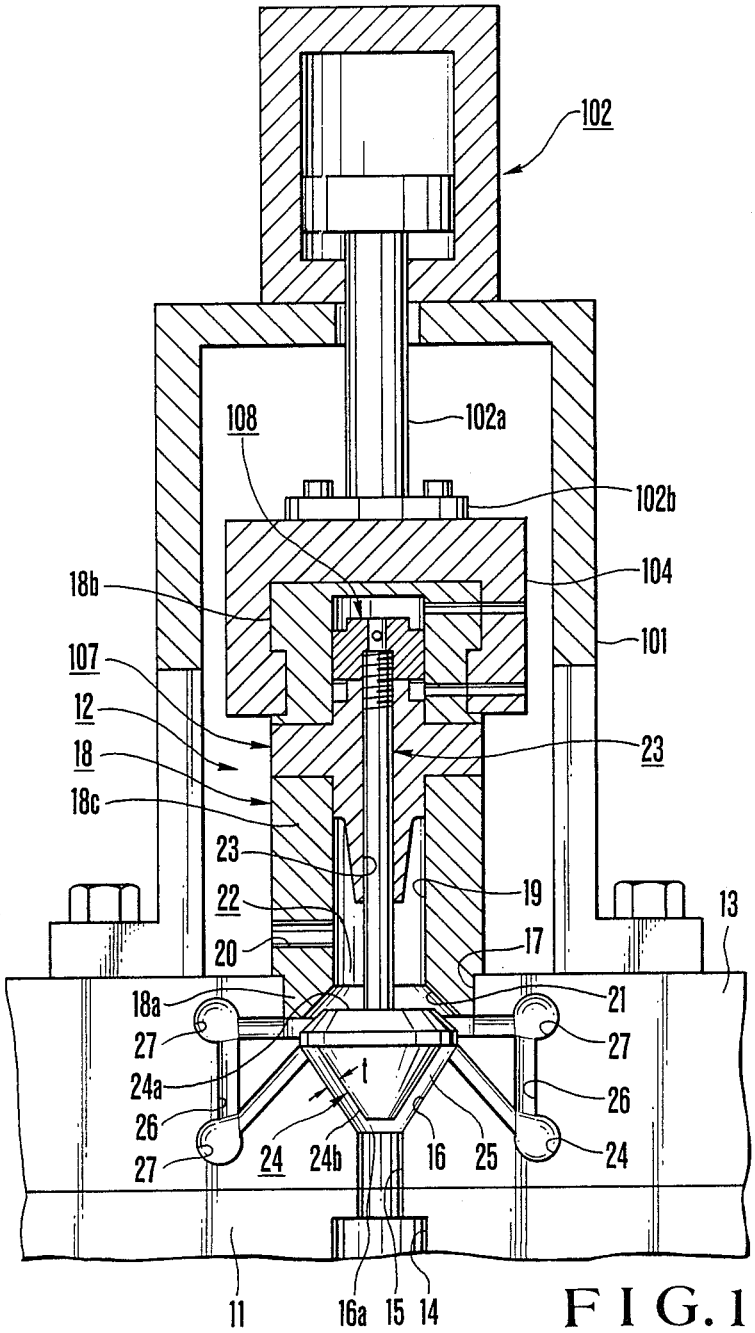

FIG. 1 is a partially sectional front view of a vent valve with its periphery of a degassing apparatus for a metal mold according to an embodiment of the present invention, and seen from metal mold dividing surfaces. Referring to FIG. 1, a metal mold 11 is divided into front and rear portions with respect to the surface of the sheet of drawing. A degassing block 13 of a metal mold degassing apparatus 12 mated with the metal mold 11 is divided by the same dividing surfaces. A cavity 14 is formed in the metal mold 11. A vent groove 15 continuous to the cavity 14 and having a section area slightly smaller than that of the cavity 14, a large-diameter frustoconical hole 16 having a shape of a head-cutting circular cone, and a cylindrical hole 17 are formed in the degassing block 13. They constitute a vent groove communicating with an exhaust port 20. A hollow cylindrical portion or spool 18 is fitted in the cylindrical hole 17. A valve chamber 19 serving as an inner hole and the exhaust port 20 for communicating with an outer air or a vacuum suction unit are formed in the outer surface of the cylindrical portion 18. A valve seat 21 is formed in the lower end of the cylindrical portion 18. A valve 22 is integrally formed with a valve rod 23 and a valve body 24 and is vertically movable. In FIG. 1, the valve 22 is at a lower limit position. The valve body 24 of the valve 22 consists of an integrity of disk-like valve portion **24*a* and a valve head 24*b*. The valve portion 24*a* is fitted with the valve seat 21 when the valve body 24 is moved upward. The valve head 24*b* is similar to the frustoconical hole 16 but has a size smaller than that of the frustoconical hole 16. A gas vent path 25 is defined by the surface of the valve head 24*b* having a flat head and the frustoconical hole 16. When the valve 22 is at its lower limit position, the gas vent path 25 running along the surface of the valve head 24*b* has a width t. The gas vent path 25 extends to the outer surface of the disk-like valve portion 24*a* as the base portion of the valve body 24. Bypasses 26 as the vent paths bypassing in the triangular manner are formed in two side portions of the gas vent path 25. The start and end portios of each bypass 26 communicate with the end portion of the gas vent path 25 and the valve open portion, respectively. Molten metal reservoirs 27 are provided at the corners of the bypasses 26**.

Note that in FIG. 1 reference numeral 101 denotes a bracket fixed on the degassing block 13 by an appropriate clamping means. A hydraulic cylinder 102 is fixed to the bracket 101. A flange **102*b* is provided to the lower end of a piston rod 102*a* of the hydraulic cylinder 102, and a main body of the degassing apparatus 12 for a metal mold is fixed to the flange 102*b* through a holder 104 at an upper end of the degassing apparatus by bolts. The main body of the degassing apparatus 12 for a metal mold includes the cylindrical spool 18 having a bottom surface and an upper end clamped by the holder 104**.

A small-diameter stepped portion **18*a* at a lower end of the spool 18 is fitted in the cylindrical hole 17 of the degassing block 13, as described above. During injection molding, the main body of the degassing apparatus 12 for a metal mold is set in the state described above when the piston rod 102*a* is moved downward. When injection molding is completed and when the mold is disassembled to allow cleaning of the valve head or the like, the piston rod 102*a* is moved backward to disengage the small-diameter stepped portion 18*a* from the cylindrical hole 17, and the small-diameter stepped portion 18*a* and the valve body 24 are located outside the degassing block 13**.

The spool 18 is divided into upper and lower members **18*b* and 18*c*. A flange of a valve guide 107 fitted in the inner hole 19 is clamped between the members 18*b* and 18*c*. The upper and lower members 18*a* and 18*b* and the valve guide 107 are integrated. The valve rod 23 extends through the inner hole of the valve guide 107. A piston 108 slidably housed in the inner hole of the upper member 18*b* of the spool 18 is coupled to the upper end of the valve rod 23**.

The operation of the degassing apparatus for a metal mold having the above arrangement will be described. When the molten metal is charged into the cavity 14 of the metal mold 11, the gas in the cavity 14 flows into the bypasses 26 through the vent groove 15 and the gas vent path 25. The gas then enters the valve chamber 19 through the valve open portion and is exhausted through the exhaust port 20. A vacuum suction unit can be connected to the exhaust port 20 to perform vacuum suction of gas.

When molten metal fills the cavity 14, it overflows to the vent groove 15, reaches the start portion **16*a* of the gas vent path 25, and flows upward in the gas vent path 25. Before the molten metal flowing upward enters the bypasses 26, its total weight acts on the frustoconical hole 24*b* which extends downward from the valve head 24 and which has a flat head. In other words, an inertia force of a large mass acts on the valve head 24. Therefore, the valve 22 is moved upward and reliably engaged with the valve seat 21 to fully close the valve. As a result, the molten metal does not enter the valve chamber 19**.

Figure 2:
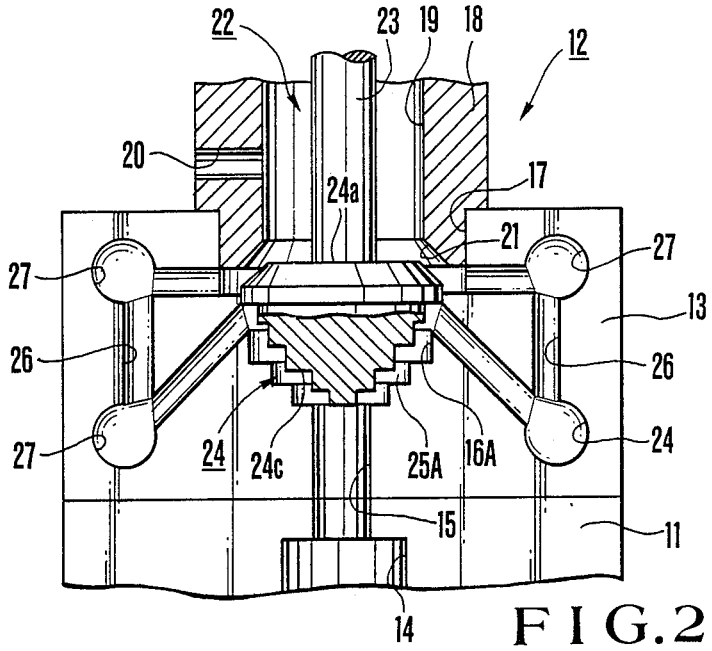

FIG. 2 is a partially sectional front view of a vent valve with its periphery according to another embodiment of the present invention and corresponding to FIG. 1. In this embodiment, a portion 16A of the gas vent path 25 that opposes the valve head **24*c* of the frustoconical hole 24*b* and the valve head 24*c* are formed in a stepped manner. Excluding them, FIG. 2 is the same as FIG. 1. The same reference numerals in FIG. 2 denote the same portions as in FIG. 1 and a detailed description thereof is omitted. With this arrangement, in the apparatus shown in FIG. 2, in addition to the effects the same as those with the apparatus shown in FIG. 1, when the molten metal flows through the stepped gas vent path 25A**, a resistance is given to the flow. Therefore, the pressure of molten metal is increased and the valve can thus be closed more reliably.

A tapered portion or a restrictor can be provided to the gas vent path 25 to give resistance to the flow of the molten metal.

Figure 3:
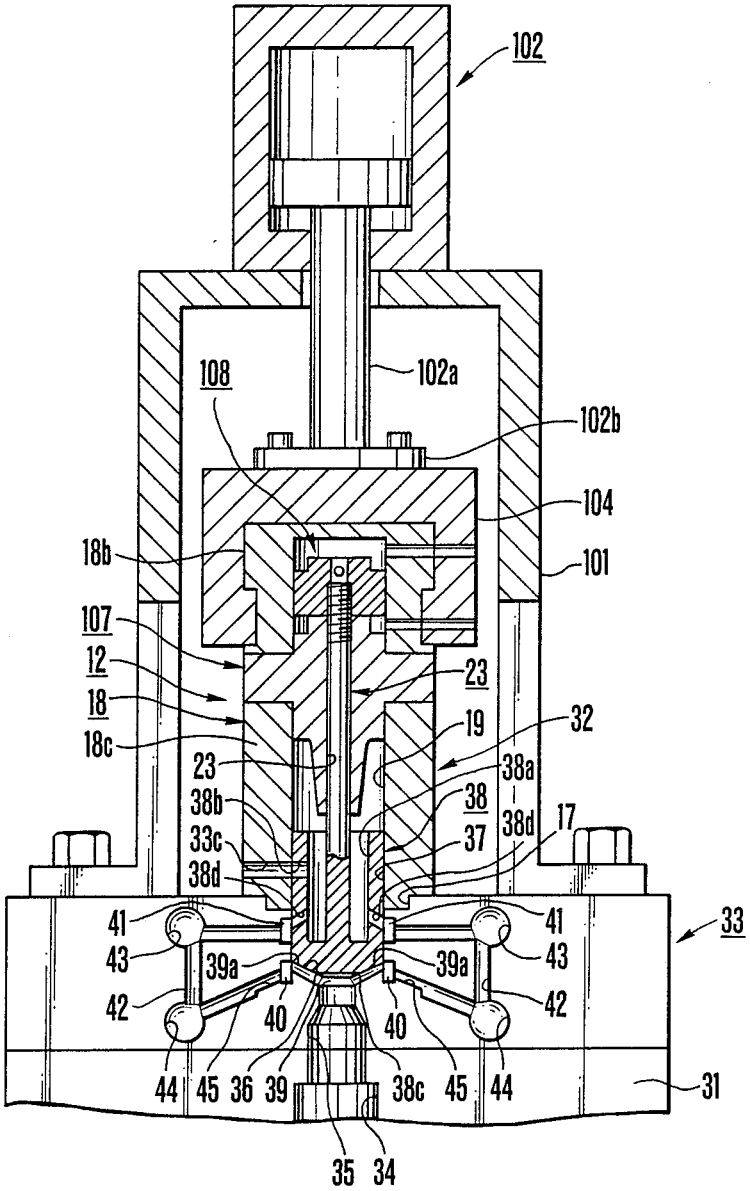

A still another embodiment of the present invention will be described with reference to FIG. 3. FIG. 3 shows a degassing apparatus for a metal mold according to still another embodiment of the present invention. Referring to FIG. 3, components 101 to 107 denote the same parts as in FIG. 1 and a detailed description thereof is omitted. A metal mold 31 is divided into front and rear portions with respect to the surface of the sheet of drawing. A degassing block 33 of a metal mold degassing apparatus 32 mated with the metal mold 31 is also divided by the same dividing surfaces. A cavity 34 is formed in the metal mold 31. A gas vent groove or hole 35, a large-diameter conical hole 36 continuous with the gas vent groove 35, and a spool hole 37 are formed in the degassing block 33. The gas vent groove 35 is continuous with the cavity 34 and has a section slightly smaller than that of the cavity 34. A hollow spool 38 as a base of the valve body is arranged in the spool hole 37. The spool 38 can swing since it is biased by a spring member 151 toward the metal mold 31. An exhaust port 38*b* is formed in the outer surface of the spool 38. When the spool is at its lowest position, the exhaust port 38*b* corresponds to the exhaust port 33*a* of the degassing block 33 to communicate with the outer air. When the spool 38 is at its lowest position as shown in FIG. 3, the frustoconical hole 38*c* at its lower end opposes the bottom of the conical hole 36. A pair of molten metal vent paths 39, having a V-shaped cross-section when seen as a whole from a direction perpendicular to the surface of the sheet of the drawing, are formed in the bottom of the conical hole 36. A restrictor 39*a* having a section tapered toward the outer direction is formed in each molten metal path 39. A pair of molten metal reservoirs 40 are formed to be in contact with the periphery of the bottom of the conical hole 36. Each reservoir 40 communicates with the corresponding molten metal path 39 through the corresponding restrictor 39*a*. Another pair of molten metal reservoirs 41 are formed above the reservoirs 40 and communicate with valve chamber 38*a* through through holes 38*d*. The upper and lower reservoirs 41 and 40 communicate with each other through bypasses 42 that bypass to the side of the spool hole 37 serving as the travel path of the spool 38. Reservoirs 43 and 44 are formed at the corners of the bypasses 42. The inlet ports of the bypasses 42 on the side of the reservoirs 40 are restricted to form a restrictor 45.

The operation of the degassing apparatus for a molten metal having the above arrangement will be described. When molten metal is injected into the cavity 34 of the molten metal 31, the gas in the cavity 34 is guided to the reservoirs 40 through the gas vent groove 35 and the molten metal paths 39, flows into the valve chamber 38*a* through the bypasses 42, the reservoirs 41, and the through holes 38*d*, and is exhausted outside through the exhaust ports 38*b* and 33*a*. A vacuum suction unit can be connected to the exhaust port 33*a* to draw the gas by suction. In this valve open state, the molten metal paths 39 sufficient for degassing are formed under the spool 38.

When the molten metal fills the cavity 34, it overflows to the gas vent groove 35 and reaches the base of the molten metal paths 39. Since the inertia force of the molten metal having a large mass acts on the frustoconical surface 38*c* of the spool 38, the spool 38 is moved upward, and the through holes 38*d* do not correspond to the reservoirs 41 and the exhaust port 38*b* do not correspond to the exhaust port 33*a*. As a result, the molten metal does not flow into the valve chamber 38*a*.

When the flow speed of molten metal into the gas vent groove 35 is low and thus the inertia force of the molten metal is small, the spool 38 is not moved upward in the conventional case. However, according to the apparatus of the present invention, since the restrictors 39*a* are formed in the molten metal paths 39, the restrictors 39*a* serve as resistance to the flow of the molten metal, and the pressure in the paths 39 and the groove 35 is increased. Since the increased pressure acts on the spool 38, the spool 38 is moved upward to close the through holes 38*d*. Therefore, the molten metal does not flow into the valve chamber 38*a*. The molten metal enters the bypasses 42 through the reservoirs 40. Since the restrictors 45 are formed in the inlets of the bypasses 42, they serve as resistance to the flow of the molten metal, so that the pressure in the molten metal paths 39 and the gas vent groove 35 is further increased to promote valve closing operation. With the reservoirs 40, 41, 43, and 44, the flow of the molten metal is delayed to reach the inlet of the valve chamber 38*a*. The molten metal does not reach the inlet of the valve chamber 38*a* earlier than the valve closing timing.

Figure 4:
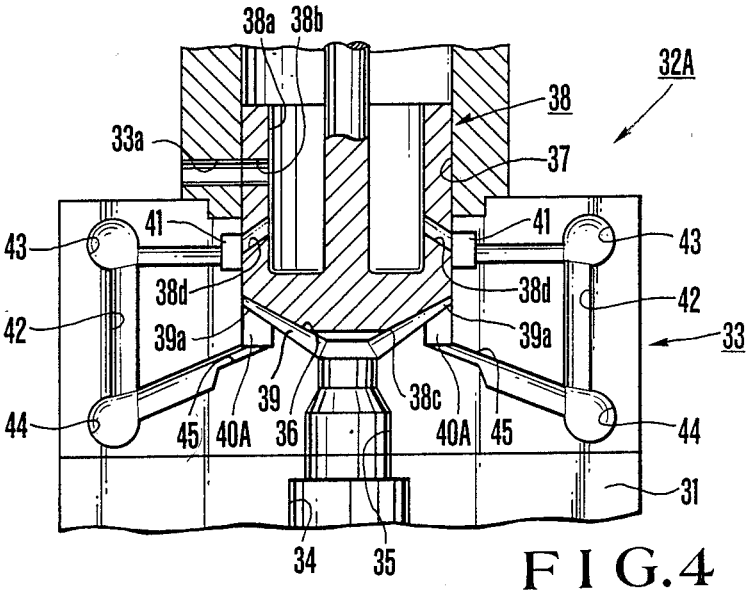

FIG. 4 is a longitudinal sectional view of a vent valve with its periphery according to still another embodiment of the present invention and corresponding to FIG. 3. In a metal mold degassing apparatus 32A of this embodiment, reservoirs 40A are formed under restrictors 39*a*. Excluding this, the arrangement and operation of this embodiment are the same as those of the embodiment described above. The same reference numerals as in FIG. 3 denote the same portions in FIG. 4 and a detailed description thereof is omitted. In FIGS. 3 and 4, the gas vent groove 35 communicates with a circular recess formed in the bottom of the frustoconical hole 38*c* housing the valve head and with two groove-like gas vent paths extending from the circular recess toward the bypasses 42.

Figure 5:
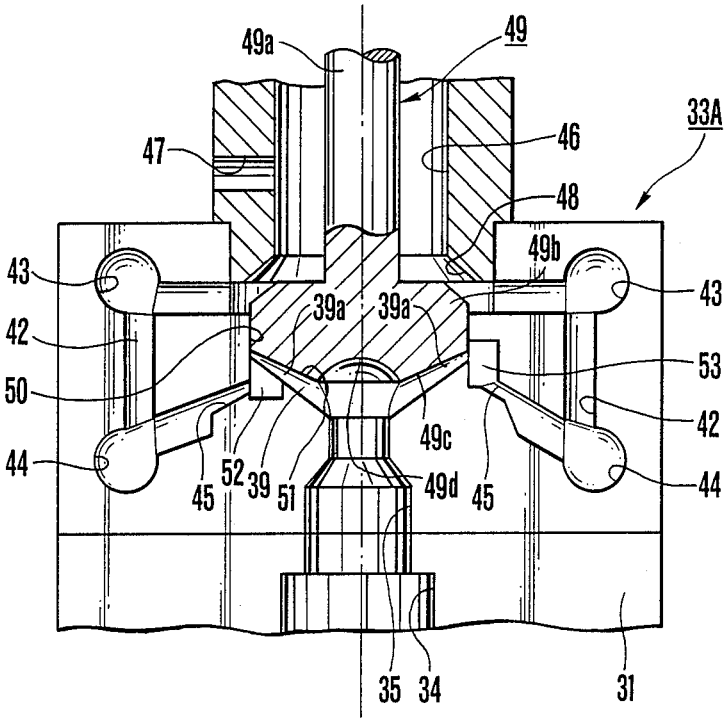

In the above embodiments, the present invention is applied to a spool-type metal mold degassing apparatus. However, the present invention can be similarly applied to a valve seat-type metal mold degassing apparatus. FIG. 5 is a longitudinal sectional view of a gas vent valve with its periphery of such a valve seat-type metal mold degassing apparatus. In FIG. 5, the right and left halves show different structures. The same reference numerals as in FIGS. 3 and 4 denote the same portions in FIG. 5 and a detailed description thereof is omitted.

A degassing block 33A has a valve chamber 46 as its inner hole. An exhaust port 47 for communicating the valve chamber 46 with the outer air is formed in the outer wall of the valve chamber 46. A valve seat 48 is formed at the lower end of the valve chamber 46. A gas vent valve 48 consists of a valve rod 49*a* and a valve body 49*b*. A surface to be fitted with the valve seat 48 is formed in the valve body 49*b*. When the valve body 49*b* is vertically moved in a valve hole 50, the valve seat 48 is opened or closed. When the valve body 49*b* is at its lowest position, as shown in FIG. 5, its valve head or the lower end conical surface 49*c* opposes a lower end conical surface 51 of the valve hole 50, and a pair of molten metal vent paths 39 having restrictors 39*a* are formed in the conical surface 51 in the same manner as in the embodiment described above. A recess 49*d* is formed in the top of the valve head of the valve body 49 so that the valve body 49 can be easily operated by the molten metal. In the embodiment shown in the left half of FIG. 5, a reservoir 52 is formed downstream of the restrictor 39*a*. In the structure shown in the right half of FIG. 5, a reservoir 53 is formed outside the restrictor 39*a*.

With the above arrangement, the gas in a cavity 34 flows into the valve chamber 46 through a gas vent groove 35, the molten metal paths 39, bypasses 42, and the valve seat 48, and is exhausted through the exhaust port 47. The molten metal overflowing from the cavity 34 impinges on the lower surface of the valve body 49*b* and moves the gas vent valve 49 upward with its inertia force. Therefore, the valve seat 48 is closed by the valve body 49*b*. When the flow speed of the molten metal is low and thus its inertia force is small, the valve seat 48 is closed by the valve body 49*b* since resistance caused by the restrictors 39*a* and 45 acts to increase the pressure in the molten metal paths 39 and the gas vent groove 35 in the same manner as described in the above embodiments.

Figure 6:
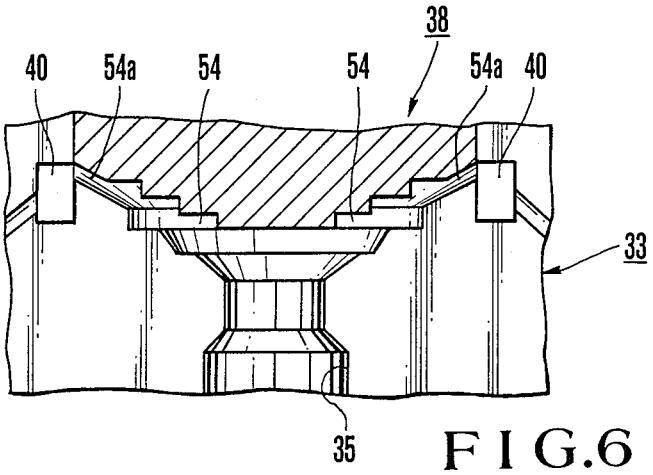

FIG. 6 is a longitudinal sectional view of a molten metal path with its periphery according to still another embodiment of the present invention. In this embodiment, molten metal paths 54 corresponding to the molten metal paths 39 of the above embodiments are formed in the stepwise manner. In this case, steps of the valve head defining the steps of the molten metal paths 54 and the steps formed in the block 33A do not correspond to each other, but constitute restrictors 54*a*. With this arrangement, a resistance is caused by the stepwise wall of the paths and acts on molten metal flowing through the molten metal paths 54. As a result, together with the resistance in the restrictors 54*a*, the valve closing operation becomes further reliable.

If a cooling hole is formed near each bypass 42 to cool the overflowing molten metal, the flow resistance can be further increased to more reliably close the valve.

As apparent from the above description, according to the present invention, in a degassing apparatus for a metal mold, the valve body of the valve is substantially conical, the end portion of the gas vent groove is gas vent paths extending to near the base of the outer surface of the valve body along the surface of the conical valve body, and the start portions of the bypasses communicate with the end portions of the gas vent paths. Therefore, molten metal overlowing from the cavity flows in the gas vent paths from the gas vent groove along the conical surface of the valve head. In this case, since a total weight of molten metal acts on the valve body before molten metal enters the bypasses, the valve is reliably closed and molten metal does not enter the valve chamber or blow to the outside, resulting in increased durability of the apparatus and safeness of operation.

The valve body of the valve is substantially conical. The end portions of the gas vent paths formed along the surface of the valve body communicate with the start portions of bypasses. Restrictors are formed in the vicinity of each communicating portion. As a result, resistance is given to the flow of the molten metal while gas can flow through the restrictor. Therefore, molten metal pushes the conical surface of the valve body to close the valve, as described above. Even when the inertia force of the molten metal acting on the valve body is small, the pressure in the gas vent groove is increased due to the resistance of the restrictor. Therefore, the gas vent valve is reliably closed, the molten metal does not enter the valve chamber of blow outside the apparatus, thus resulting in increased durability of the apparatus and safeness of operation.

However, in the embodiments described above, since the gas vent paths are narrow and long, some problems arise in regard to the gas exhaust capacity. Also, the inertia force of the molten metal is not always optimum because of the shape of the valve head or gas vent paths.

Figure 7:
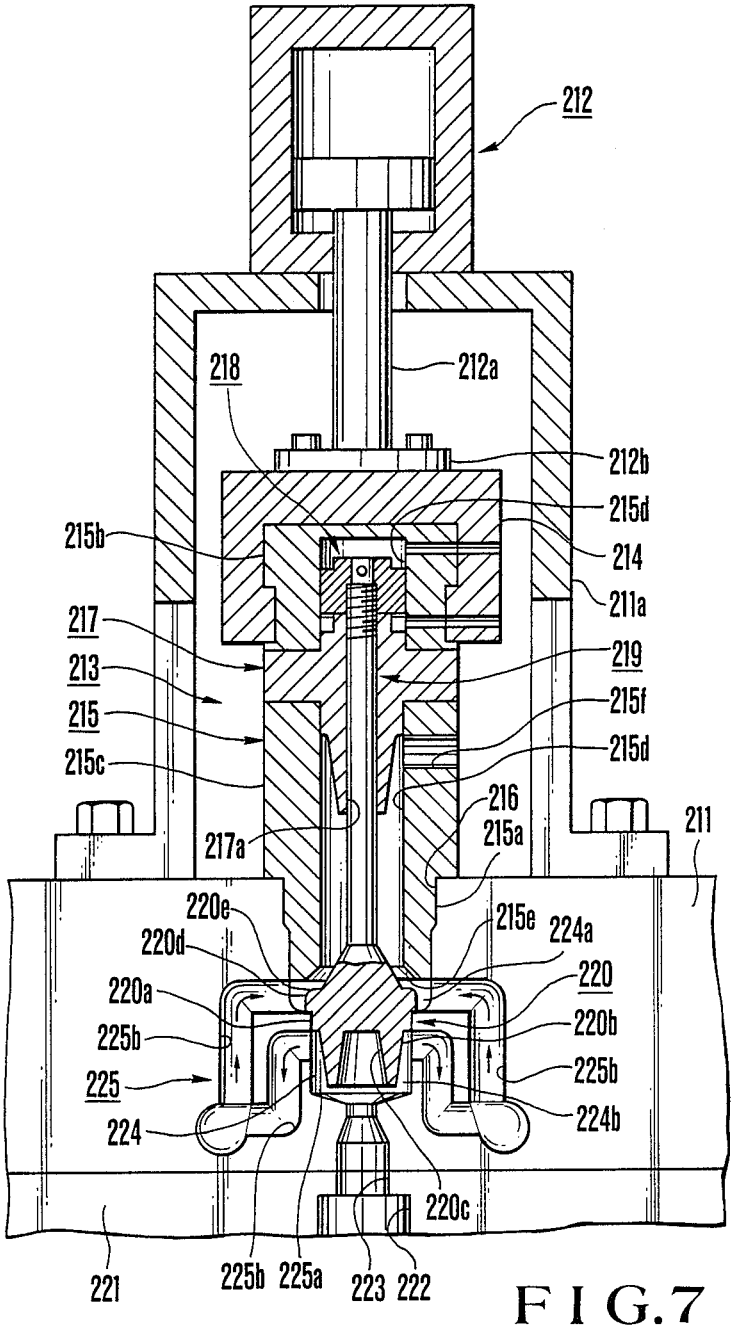
FIGS. 7 and 8 are longitudinal sectional views showing still other embodiments of the present invention.

FIG. 7 shows a degassing apparatus for a metal mold according to still another embodiment of the present invention.

Referring to FIG. 7, a degassing block 211 is mounted on the split surface of either metal mold, i.e., a stationary or movable metal mold. A hydraulic cylinder 212 is fixed on a bracket 211*a* fixed on the upper surface of the degassing block 211. A main body 213 of a degassing apparatus for a metal mold is fixed to a flange 212*b* through a holder 214 at its upper end by bolts. The flange 212*b* serves as an operating end of a piston rod 212*a*. The main body 213 of the degassing apparatus for a metal mold has a cylindrical spool 215 having a bottom surface and an upper end clamped by the holder 214. A small-diameter stepped portion 215*a* at the lower end of the spool 215 is detachably fitted in a spool hole 216 in the degassing block 211. During injection molding, when gas in a metal mold cavity 222 is exhausted or when the valve is closed using the main body 213 of the degassing apparatus for a metal mold, the piston rod 212*a* is moved forward and the small-diameter stepped portion 215*a* is fitted in the spool hole 216, as shown in FIG. 7. After injection, when the mold is to be opened for the purpose of cleaning of the valve head or the like, the piston rod 212*a* is moved backward to disengage the small-diameter stepped portion 215*a* from the spool hole 216, and the small-diameter stepped portion 215*a* and the valve head are dislocated outside the degassing block 211. The spool 215 is divided into upper and lower members 215*b* and 215*c*. A flange of a valve guide 217 fitted in an inner hole 215*d* is clamped between the upper and lower members 215*b* and 215*c*, so that the members 215*b* and 215*c* are integrated. A piston 218 is located above the valve guide 217 and slidably fitted in the inner hole 215*d* of the member 215*b* of the spool 215. A threaded portion of a valve rod 219 is screwed in the central screw hole of the piston 218 to be integral with the piston 218. The valve rod 219 is movably engaged with the inner hole 217*a* of the valve guide 217 and extends in the small-diameter stepped portion 215*a* at the lower end of the spool 215. A valve head 220 to be described later is integrally formed at the lower end of the valve rod 219.

The degassing block 211 and the metal mold 221 connected to it are divided into front and rear portions with respect to the surface of the sheet of the drawing. A cavity 212 is formed in the metal mold 221. A gas vent groove 223 continuous with the cavity 222 is formed in the degassing block 211. A valve chamber 224 having a stepped cylindrical shape consisting of large- and small-diameter holes 224*a* and 224*b* is formed between the gas vent groove 223 and the spool hole 216 engaged with the spool 215. The valve body 220 is integrally formed in a stepwise manner from a columnar large-diameter portion 220*a* and a tapered small-diameter portion 220*b*. The large-diameter portion 220*a* is slidably engaged with the hole 224*b* in the small-diameter portion 220*b* of the valve chamber 224. The small-diameter portion 220*b* projects toward the gas vent groove 223 from the large-diameter portion 220*a*. A conical hole or recess 220*c* having a diameter larger than the width of the gas vent groove 223 is formed in the central portion of the end face of the valve body 220. A tapered portion 220*e* is formed on the outer surface of the upper end of a flange portion 220*d* at the base of the valve head 220. The tapered portion 220*e* constitutes a valve opening/closing portion together with a valve seat 215*e* formed in the inner surface of the lower end of the spool 215. When the valve head 220 is moved upward by the molten metal flowing from the cavity 222, the tapered portion 220*e* is urged by the valve seat 215*e* to close the valve. The valve is opened when air or oil is supplied to an upper subchamber of the piston 218 in accordance with an instruction supplied from a controller. However, this mechanism is not shown or described in detail since it is not directly concerned with the present invention. The valve may be forcibly closed when air or oil is supplied to a lower subchamber of the piston 218.

A bypass 225 which is continuous with the gas vent groove 223 consists of a path 225*a* extending along the end face and outer surface of the tapered small-diameter portion 220*b* of the valve head 220 and communicating with the gas vent groove 223, and a pair of bypass conduits 225 b starting from the side surfaces of the small-diameter portion 220*b* and communicating with the valve chamber 224 immediately before the valve seat 215*e*. In the embodiment shown in FIG. 7, each bypass conduit 225*b* extends in the horizontal direction by a short distance, downward, in the outward horizontal direction, upward, and finally in the inward horizontal direction, thus reaching a position immediately before the valve seat 215*e*. The bypass conduit 225*b* can be of another shape if it has a sufficient length. An exhaust hole 215*f* opens in the inner hole 215*d* of the spool 215. When the valve is opened, the gas in the cavity 222 flows into the inner hole 215*d* in the spool 215 through the gas vent groove 223, the path 225*a*, the bypass conduits 225*b*, and the hole 224*a* in the large-diameter portion in the upper portion of the valve chamber 224, and is exhausted outside through the exhaust hole 215*f*.

In this embodiment, the thickness of the large-diameter portion 220*a* of the valve head 220 slidably formed in the hole 224*b* of the small-diameter portion of the valve chamber 224 is larger than the size in the valve open state, i.e., the distance between the valve seat 215*e* in the open state and the tapered portion 220*e* in the axial direction. When the valve is closed, the molten metal does not directly flow into the hole 224*a* of the large-diameter portion of the valve chamber 224 along the periphery of the large-diameter portion 220*a*.

The length of the tapered small-diameter portion 220*b* of the valve head 220 in the axial direction is larger than the width of the portion of the bypass conduit 225*b* extending from the base of the small-diameter portion 220*b* in the horizontal direction when the valve is in the open state. The length of the small-diameter portion 220*b* in the axial direction is preferably twice or more than the width of the bypass conduits 225*b* or larger than the width of the bypass conduits 225*b* plus the size in the valve open state. This is because the molten metal flowing from the gas vent groove 223 in the horizontal direction along the end face of the valve head 220 may not easily enter the bypass conduits 225*b*.

The path 225*a* formed to extend along the end face and the outer surface of the tapered small-diameter portion 220*b* of the valve head 220 in the valve open state is appropriately formed to be narrow. As a result, a sufficient gas exhaust capacity can be obtained while the molten metal is slightly difficult to flow. More specifically, a lower surface of the path 225*a* extending along the end face of the valve head 220 is tapered so that the flow of the molten metal can be restricted in the vicinity of the periphery of the end face of the valve head 220. This restrictor is effectively operated during an instantaneous moment when the valve is open and the molten metal impinges on the valve head 220. Once the valve is started to be closed, the space of the restrictor is abruptly increased and its restrictor effect is soon disabled. In contrast to this, regarding a portion of the path 225*a* provided to surround the tapered small-diameter portion 220*b* of the valve head 220, if this portion is designed to be narrow within a range capable of sufficient gas exhaust, its restrictor effect is not substantially changed even if the valve is started to be closed, and its restrictor state is maintained even when the valve head 220 is moved in the axial direction. Since these restrictors are provided to extend along the end face and the surface of the small-diameter portion 220*b* of the valve head 220, the gas can easily flow while the molten metal cannot easily flow. When the small-diameter portion 220*b* is moderately tapered, the valve head 220 can be smoothly extracted from the solidified metal after injection, in addition to the restrictor effect.

A conical hole 220*c* is formed to extend from the end face toward the internal portion of the valve head 220. The diameter of the inlet of the conical hole 220*c* is larger than the width of the gas vent groove 220*c*. This is because the initial molten metal directly flowing from the gas vent groove 223 may reliably enter the conical hole 220*c* so that the valve can be quickly, reliably closed before the molten metal enters the path 225*a*. The hole 220*c* is formed in the valve head 220 in order to reduce the weight of the valve head 220 itself, so that the valve head 220 can be pushed up with a small force. The hole 220*c* has a conical shape to provide a draft angle and not to decrease the strength of the valve head 220 itself to a necessary level or less.

The operation of the degassing apparatus for a molten metal having the above arrangement will be described. The main body 213 of the degassing apparatus for a molten metal is set in the state as shown in FIG. 7, and the molten metal is injected into the cavity 220 of the metal mold 221 while the valve is open. The gas in the cavity 222 enters the path 225*a* through the gas vent groove 223, is diverged into the two bypass conduits 225*b* to bypass, then enters the spool 215 through a valve opening position immediately before the valve seat 215*e*, and is exhausted outside through the exhaust hole 215*f*. In this case, the cross-sectional area of the path 225*a* is set to be sufficient for gas exhaust, and the relatively wide bypass conduits 225*b* communicate with it. Therefore, the gas can flow easily and gas exhaust capacity is large. Gas can be released to outer air through the exhaust hole 215*f*. However, in many cases, a vacuum suction unit and a solenoid switching valve (not shown) are connected to the exhaust hole 215*f* and gas is drawn by vacuum suction.

When the molten metal fills the cavity 222, it quickly flows upward into the gas vent groove 223, and reliably acts on the end face of the small-diameter portion 220*b* of the valve head 220 before it enters the path 225*a*. Therefore, the valve head 220 is moved upward, the tapered portion 220*e* is brought into tight contact with the valve seat 215*e*, and the valve is perfectly closed. Then, the molten metal enters the bypass conduits 225*b* through the path 225*a*. Therefore, a portion of the molten metal in the bypass 225 or splashes or droplets of solidified metal do not clog in the valve opening/closing portion or enter the spool 215.

In this case, in the valve open state, a portion of the path 225*a* extending along the horizontal end face of the small-diameter portion 220*b* of the valve head 220, which portion corresponds to the outer surface of the valve head 220, is restricted to some extent, a portion of the valve head 220 defined by the outer surface of the small-diameter portion 220*b* of the valve head 220 is tapered, and thus a portion of the path 225*a* extending along the outer surface of the small-diameter portion 220*b* of the valve head 220 is restricted to some extent. Therefore, gas can be sufficiently exhausted through the path 225*a*. However, due to the effect of these restrictors, the molten metal cannot smoothly flow into the bypass conduits 225*b* through the path 225*a*. In the valve open state, the path 225*a* is narrowed both with the end face and outer surface of the small-diameter portion 220*b*. Once the valve is started to be closed, only the outer surface of the small-diameter portion 220*b* keeps defining a restriction along with the valve closing operation and the restrictor defined by the end face of the small-diameter portion 220*b* is quickly disabled. In this case, however, since the valve is kept closed, no problems occur.

In this manner, the molten metal does not easily enter the path 225*a* and the bypass conduits 225*b*. Meanwhile, the conical hole 220*c* is formed to extend from the end face toward the inner portion of the valve head 220, so that the weight of the valve head 220 itself is decreased, thus facilitating pushing up of the valve. In addition, the diameter of the inlet of the conical hole 220*c* is slightly larger than the width of the gas vent groove 223. Therefore, most of the molten metal quickly flowing from the gas vent groove 223 first enters the conical hole 220*c* and easily pushes up the valve head 220.

In this manner, because of the combination of the effect to cause the molten metal to reliably act on the valve head 220 and the restrictor effect of the path 225*a* to prevent the molten metal from flowing ito the path 225*a* and bypass conduits 225*b* as much as possible, the valve can always be closed reliably and quickly without causing clogging of the molten metal or its splashes in the valve seat 215 or portions continuous after the valve seat 215. With the above arrangement, the valve can be quickly closed even when only a small amount of molten metal is supplied or when the molten metal is supplied at a low speed, thus providing a somewhat weak inertia force of the molten metal, not to speak of a case when a large amount of solidified metal flows from the gas vent groove 223.

When the molten metal is pressurized and cooled, the main body 13 of the degassing apparatus is moved upward by the cylinder 212 to separate the valve head 220 from the metal filled and solidified in the gas vent groove 223 and the bypass conduits 225*b*. Then, the mold is opened and the product is picked up.

Figure 8:
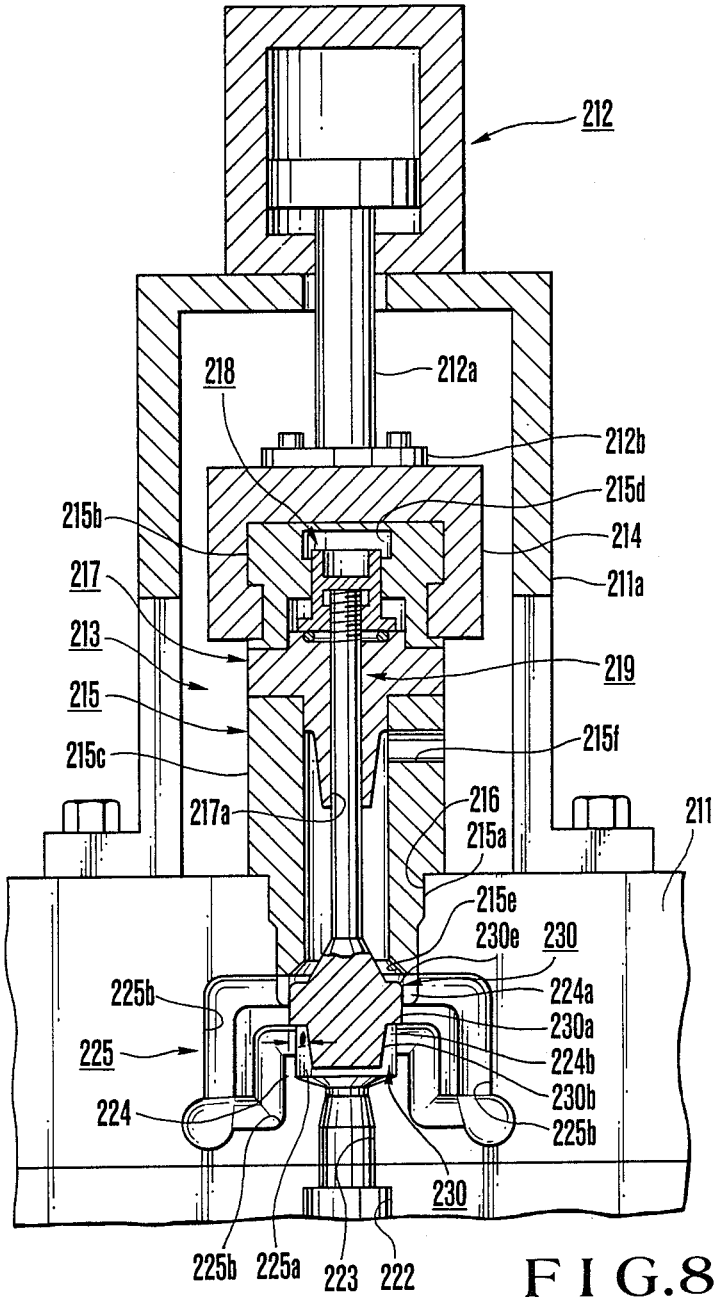

FIG. 8 is a longitudinal sectional view of still another embodiment of the present invention and partially corresponding to FIG. 7. The same reference numerals as in FIG. 7 denote the same portions in FIG. 8 and a detailed description thereof is omitted. In FIGS. 7 and 8, the valve chamber 224 constitutes an annular gas vent path extending from the vent groove 223 to the bypass 225. In this embodiment, a valve head 230 is a two-step valve head consisting of a large-diameter portion 230*a* and a tapered small-diameter portion 230*b*. The large-diameter portion 230*a* has a tapered portion 230*e* on the outer surface of its upper portion. When the valve is opened, the tapered portion 230*e* is brought into tight contact with a valve seat 215*e*. More specifically, the upper flange 220*d* shown in FIG. 7 is not provided in FIG. 8, and a portion corresponding to the flange 220*d* has the same diameter as that of the large-diameter portion 230*a*. A small-diameter hole 224*b* in the lower portion of the valve chamber 224, in which the valve head 230 is located, is formed to have a vertical two-step shape, and the lower step has a diameter smaller than the upper step. With this arrangement, the diameters of the valve head 230 and the spool 215 can be more or less reduced, so that the entire apparatus can be made compact and the valve is more or less reduced in weight, thus facilitating movement of the valve.

When the width l of the step shown in FIG. 8 is slightly increased, gas can flow more easily, and the exhaust capacity is also improved. In FIG. 8, the bottom of the small-diameter portion 230*b* is flat in order to show still another embodiment. However, a hole having a diameter larger than the width of the gas vent groove 223 can be formed in the bottom of the small-diameter portion 230*b* in the same manner as in FIG. 7, so that the molten metal can easily behave and the weight of the valve head 230 is decreased to further enable easy closing of the valve.

As apparent from the above description, even with the arrangement shown in FIG. 8, the molten metal flowing upward from the cavity through the gas vent groove cannot relatively easily flow through a portion defined by the end face and outer surface of the valve head since this portion is restricted. Inversely, the total weight of the molten metal reliably acts on the end face of the small-diameter portion of the valve head as a large inertia force in turn before the molten metal enters the bypass as the bypass conduits. Therefore, the valve can be reliably fully closed, and the molten metal or its solidified splashes do not enter the valve chamber or blow outside the apparatus, resulting in an increase in durability of the apparatus and an improvement of the operation safeness. The gas flowing into the gas vent groove from the cavity enters an annular path having a cross-sectional area which may be small as a molten metal path but large as a gas exhaust path, and then flows toward the valve opening/closing portion through a bypass conduit having a wide opening communicating with the entire surface of the path. Therefore, gas can easily flow and can be exhausted reliably, thus improving the quality of the molded product.

When a hole having a diameter larger than the width of the gas vent groove is formed in the valve head, the molten metal can act on the valve head more easily, thus further increasing the speed and improving reliability of the valve closing operation.

What is claimed is:

1. A degassing apparatus incorporated with a metal mold, comprising:

valve means, slidably provided between an end of a degassing channel communicating with said metal mold cavity and a valve opening/closing portion before an exhaust port and having a surface on which a molten metal flowing from said cavity acts, for moving toward the exhaust port and for blocking a path toward the exhaust port; and a bypass for bypassing a valve head of said valve means from said degassing channel and guiding gas to the exhaust port, wherein said valve means has said valve head having a substantially head-cutting conical outer shape projecting in the direction of said degassing channel, said degassing channel has a gas vent path extending from a top portion to the vicinity of the base of said valve head along an outer surface of said valve head, and an end portion of said gas vent path corresponding to the base of said valve head communicates with a start portion of said bypass which bypasses said valve head.

2. An apparatus according to claim 1, wherein a restrictor is provided in the vicinity of a coupling of said start portion of said bypass and said end portion of said gas vent path to give resistance to the flow of the molten metal.

3. An apparatus according to claim 1, wherein said top portion of said valve head has a recess so that the molten metal can easily act on said valve head.

4. An apparatus according to claim 3, wherein a diameter of said recess is larger than a size of a section of a portion of said degassing channel opposing said recess.

5. An apparatus according to claim 1, wherein said bypass has a reservoir at its corner.

6. An apparatus according to claim 1, wherein an outer surface of said valve head is formed stepwise, and a portion of a degassing block that opposes said outer surface and defines said gas vent path is also formed stepwise.

7. An apparatus according to claim 6, wherein a restrictor is formed by causing both stepped portions not to correspond to each other.

8. An apparatus according to claim 1, wherein a sectional area of said gas vent path through which a fluid flows is decreased from its start portion toward its end portion.

9. An apparatus according to claim 1, wherein said base of said valve head is hollow, and a hole is formed in a side wall of said valve head so that said cavity communicates with said exhaust port when said valve head is at its lowest position.

10. An apparatus according to claim 9, wherein a restrictor is provided in said gas vent path.

11. An apparatus according to claim 8, wherein a reservoir is provided downstream of said restrictor.

12. An apparatus according to claim 1, wherein a restrictor is provided in said bypass.

13. An apparatus according to claim 2, wherein a reservoir is formed downstream of said restrictor.

14. An apparatus according to claim 2, wherein a reservoir is formed outside said restrictor.

15. An apparatus according to claim 1, wherein said valve head consists of a large-diameter portion and a small-diameter portion having said head-cutting conical outer shape and projecting from said large-diameter portion toward said degassing channel, said large- and small-diameter portions defining a stepped portion in said valve head.

16. An apparatus according to claim 1, wherein a stepped portion is formed in the base of said valve head, and said start portion of said bypass is formed to oppose said stepped portion.

17. An apparatus according to claim 15, wherein a recess is formed in a top portion of said valve head.

18. An apparatus according to claim 17, wherein said recess is a conical hole, and a diameter of an inlet of said recess is larger than that of a portion of said degassing channel opposing said recess.

19. An apparatus according to claim 15, wherein a restrictor is formed in a region of said gas vent path close to said metal mold cavity.

20. An apparatus according to claim 15, wherein a length of said small-diameter portion of said valve head is larger than an opening of said start portion of said bypass communicating with said gas vent path.

* * * * *